US011407141B1

(12) United States Patent
Britton

(10) Patent No.: US 11,407,141 B1
(45) Date of Patent: Aug. 9, 2022

(54) SINGLE END TENONER (SET) WITH AUTOMATIC SQUARING AND SIZING

(71) Applicant: VOORWOOD COMPANY, Anderson, CA (US)

(72) Inventor: Adam Britton, Chico, CA (US)

(73) Assignee: VOORWOOD COMPANY, Anderson, CA (US)

( * ) Notice: Subject to any disclaimer, the term of this patent is extended or adjusted under 35 U.S.C. 154(b) by 299 days.

(21) Appl. No.: 16/546,274

(22) Filed: Aug. 20, 2019

Related U.S. Application Data

(60) Provisional application No. 62/720,007, filed on Aug. 20, 2018.

(51) Int. Cl.
*B27F 1/08* (2006.01)
*B27M 1/08* (2006.01)

(52) U.S. Cl.
CPC ..... *B27F 1/08* (2013.01); *B27M 1/08* (2013.01)

(58) Field of Classification Search
CPC . B27C 1/00; B27C 1/005; B27C 1/007; B27F 1/00; B27F 1/02; B27F 1/04; B27F 1/08; B27F 5/00; B27F 5/02; B27F 5/12; B27M 1/08; B27M 3/0066; B27M 3/18
See application file for complete search history.

(56) References Cited

U.S. PATENT DOCUMENTS 6,196,283 B1 * 3/2001 Hundegger ..... B23D 47/045 144/242.1
6,561,238 B2 * 5/2003 Knighten ..... B27F 5/12 144/2.1
10,994,438 B2 * 5/2021 Green ..... G05B 19/41875

OTHER PUBLICATIONS

SCM Woodworking Technology, Celaschi Progress—Double end tenoner for furniture elements processing, Jan. 24, 2017, https://www.youtube.com/watch?v=GjvzZweGzLE (Year: 2017).*
SCM Woodworking Technology, Flexible line with new hopper feeder for LVT flooring, Dec. 21, 2017, https://www.youtube.com/watch?v=oUGVVDC5onA (Year: 2017).*

* cited by examiner

*Primary Examiner* — Matthew Katcoff
(74) *Attorney, Agent, or Firm* — O'Banion & Ritchey LLP; John P. O'Banion

(57) ABSTRACT

A single end tenoner (SET) system and method that automatically sizes a workpiece (e.g. door or like panel) to a specified dimension, and automatically squares the edges of the workpiece, both while processing all four edges to the desires SET profile.

21 Claims, 9 Drawing Sheets

SINGLE END TENONER (SET) WITH AUTOMATIC SQUARING AND SIZING

CROSS-REFERENCE TO RELATED APPLICATIONS

This application claims priority to, and the benefit of, U.S. provisional patent application Ser. No. 62/720,007 filed on Aug. 20, 2018, incorporated herein by reference in its entirety.

STATEMENT REGARDING FEDERALLY SPONSORED RESEARCH OR DEVELOPMENT

Not Applicable

INCORPORATION-BY-REFERENCE OF COMPUTER PROGRAM APPENDIX

Appendix A referenced herein is a computer program listing in a text file entitled "VOO2003-14US-computer-program-appendix-A.txt" created on Aug. 20, 2019 and having a 16 kb file size. The computer program code, which exceeds 300 lines, is submitted as a computer program listing appendix through EFS-Web and is incorporated herein by reference in its entirety.

NOTICE OF MATERIAL SUBJECT TO COPYRIGHT PROTECTION

A portion of the material in this patent document may be subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

The technology of this disclosure pertains generally to wood working machines and methods, and more particularly to a single end tenoner (SET) with automated squaring and sizing.

2. Background Discussion

A single end tenoner (SET) is a wood working machine used to mill and sand a visually appealing profile on the edges of a substrate, such as a door, e.g. cabinet door table tops, and drawer front or the like planar panel, at high rates of production. Generally, the SET operates by automatically conveying each edge of the substrate though the milling and sanding process. A complete door is typically fed into the machine four separate times, one time for each edge. Existing SET's do not have the ability to produce doors that are sized to exact dimensions and are completely square. Whatever errors in the size or squareness that exist in the door prior to being processed through the SET, will generally persist after being processed through the SET.

BRIEF SUMMARY

An aspect of the present technology is a single end tenoner (SET) system and method that automatically sizes a workpiece (e.g. door or like panel) to a specified dimension, and automatically squares the edges of the workpiece, both while processing all four edges to the desires SET profile. In one embodiment, the SET system of the present description comprises a 17" wide chain assembly with pop-up squaring bars, an automated sizing guide (fence) having sizing sensors, a sizing arm, and automated programming for totaling the total length of doors being processed through the SET and automatically setting the sizing guide to the proper position for sizing the edges of the doors.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The technology described herein will be more fully understood by reference to the following drawings which are for illustrative purposes only:

DETAILED DESCRIPTION

Figure 1:
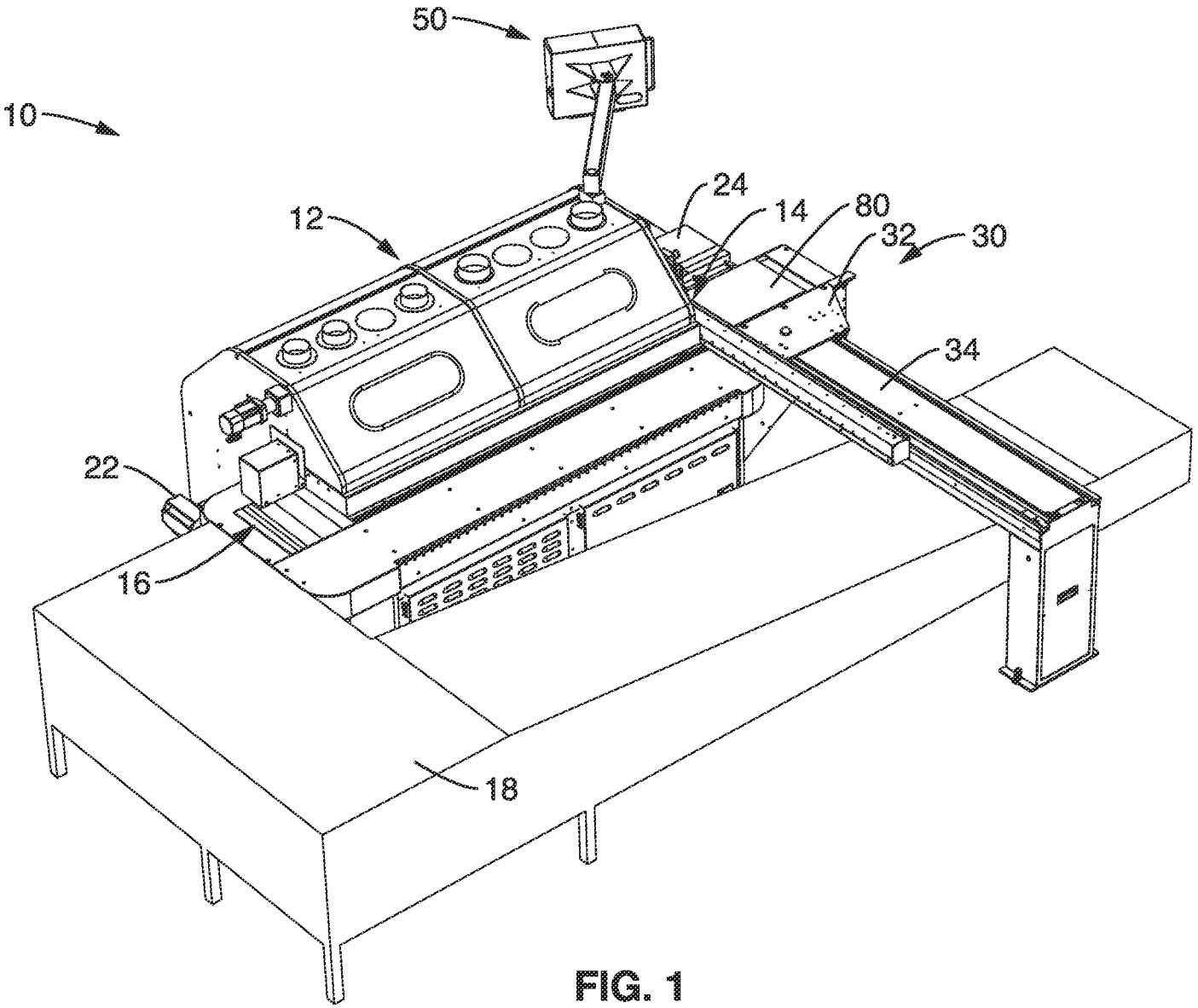
FIG. 1 is front perspective view of a SET system with automatic squaring and sizing in accordance with the present description.
Figure 2:
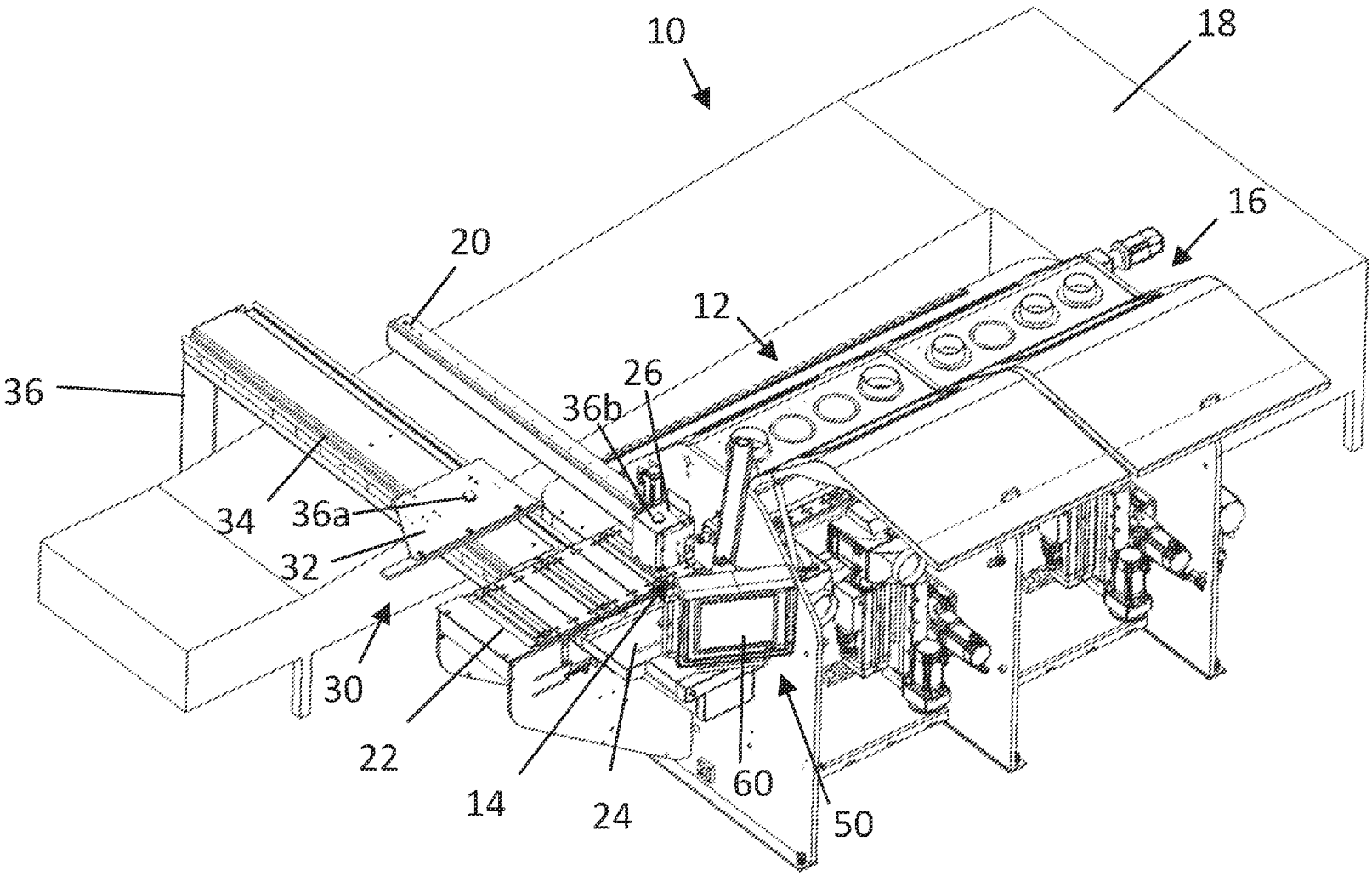
FIG. 2 is rear of the perspective view of a SET system of FIG. 1.
Figure 3:
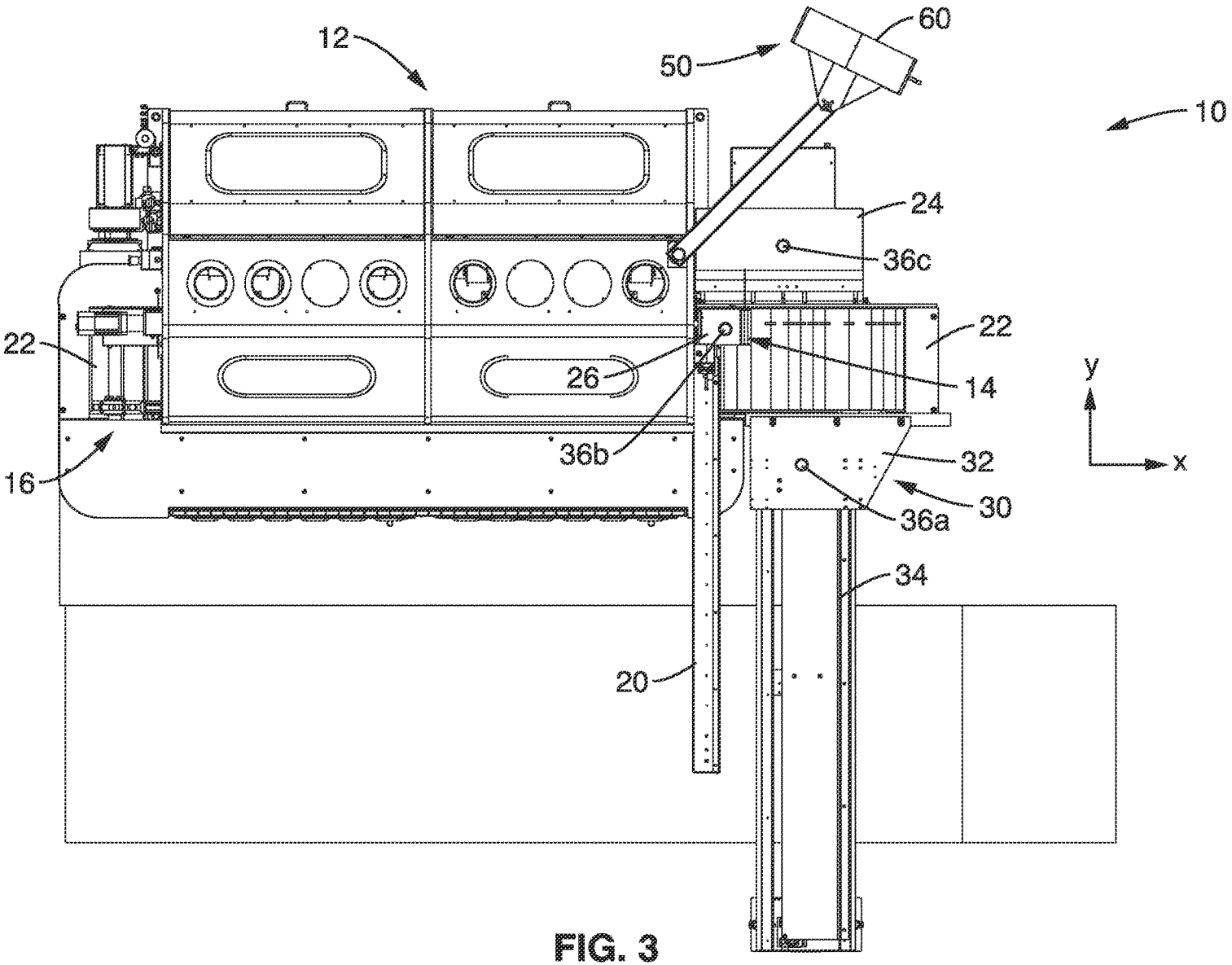
FIG. 3 is a plan view of the SET system of FIG. 1.

FIG. 1 shows a front perspective view of a SET system 10 with automatic squaring and sizing in accordance with the present description. FIG. 2 and FIG. 3 show a rear perspective view and plan view, respectively, of the SET system 10 of FIG. 1. SET system 10 comprises an SET 12 having one or more components for milling and sanding available in the art (shown under expanded doors in rear perspective view in FIG. 2).

A workpiece 80 (e.g. wooden door or like panel-shaped substrate, hereinafter referred to as "board") is positioned on chain assembly 22 at the entrance 14 of the SET 12, wherein the chain assembly 22 carries the board 80 linearly along the milling bits and sanders of the SET to profile a given edge of the board 80. Prior to being carried through entrance 14, the board is preferably positioned with an edge aligned against a stationary edge guide 24 or a moveable sizing edge guide 32, which set/determine the depth of the cut on the edge to be profiled. After the edge of the board 80 is processed through SET 12, the chain assembly 22 carries the board 80 through the exit 16 of the SET 12 and on to return conveyor 18, which returns the board 80 back to the operator for additional passes of the remainder of the board edges.

While the board is being fed onto the chain assembly 22 at the entrance 14, a scanning arm sensor 26 that is slidably disposed a sensor arm 20 takes a measurement of board length in a first direction (e.g. y-direction, FIG. 3). The sensor arm 20 allows for automated and precision linear motion of the scanning arm sensor 26 via slidable translation in the y-direction. Additionally, a linear array of sensors 28 (see FIG. 4) in the moveable sizing edge guide 32 are configured to take a measurement of board length in a second direction (e.g. x-direction, FIG. 3).

The moveable sizing edge guide 32 is coupled to an edge guide assembly 30 allowing automated and precision linear motion of the edge guide 32 via slidable translation in the y-direction along track 34. Track 34 is supported on its far end via leg 36.

A controller 50 is provided for controlling the various components of the system 10, allowing user input and system operation through a touch screen 60. A series of indicator lights 36*a*, 36*b*, and 36*c* provide indication of various edges for board 80 placement at certain stages of processing, in addition to messages provided on display 60.

Figure 4:
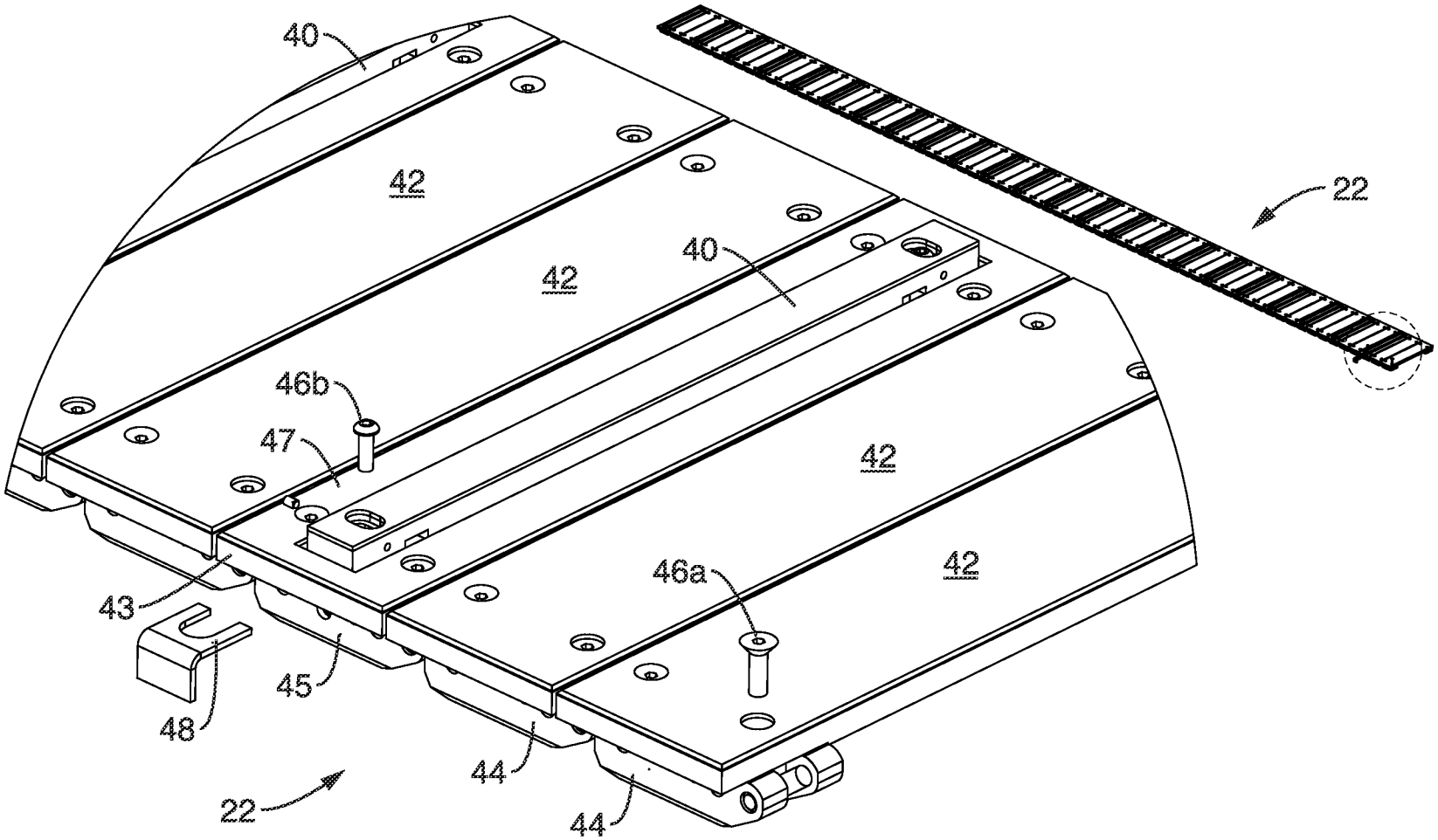
FIG. 4 is a perspective view of the chain assembly of the SET system of FIG. 1.

FIG. 4. is a perspective view of the chain assembly 22 of the SET system 10 of FIG. 1. Chain assembly comprises an array of chain pads 42 at spaced-apart intervals (e.g. 2 to 1 ratio) with dog chain pads 42 that house pop-up squaring bars 40. The chain pads 42 and dog chain pads 43 are held in series via lug assemblies 44 and 45, respectively, which are fastened to the bottom surfaces of the chain pads 42 and dog chain pad 43 via bolts 46*a*. The chain assembly 22 is sized so that the chain pads 42 have a length of 17" to accommodate a squaring bar 40 large enough to square varying sizes of doors used in the art. The pop-up squaring bars 40 are secured via bolts 46*b*, plunger 48 and set screws 47 that are tightened against the bolts 46*b*.

Figure 5:
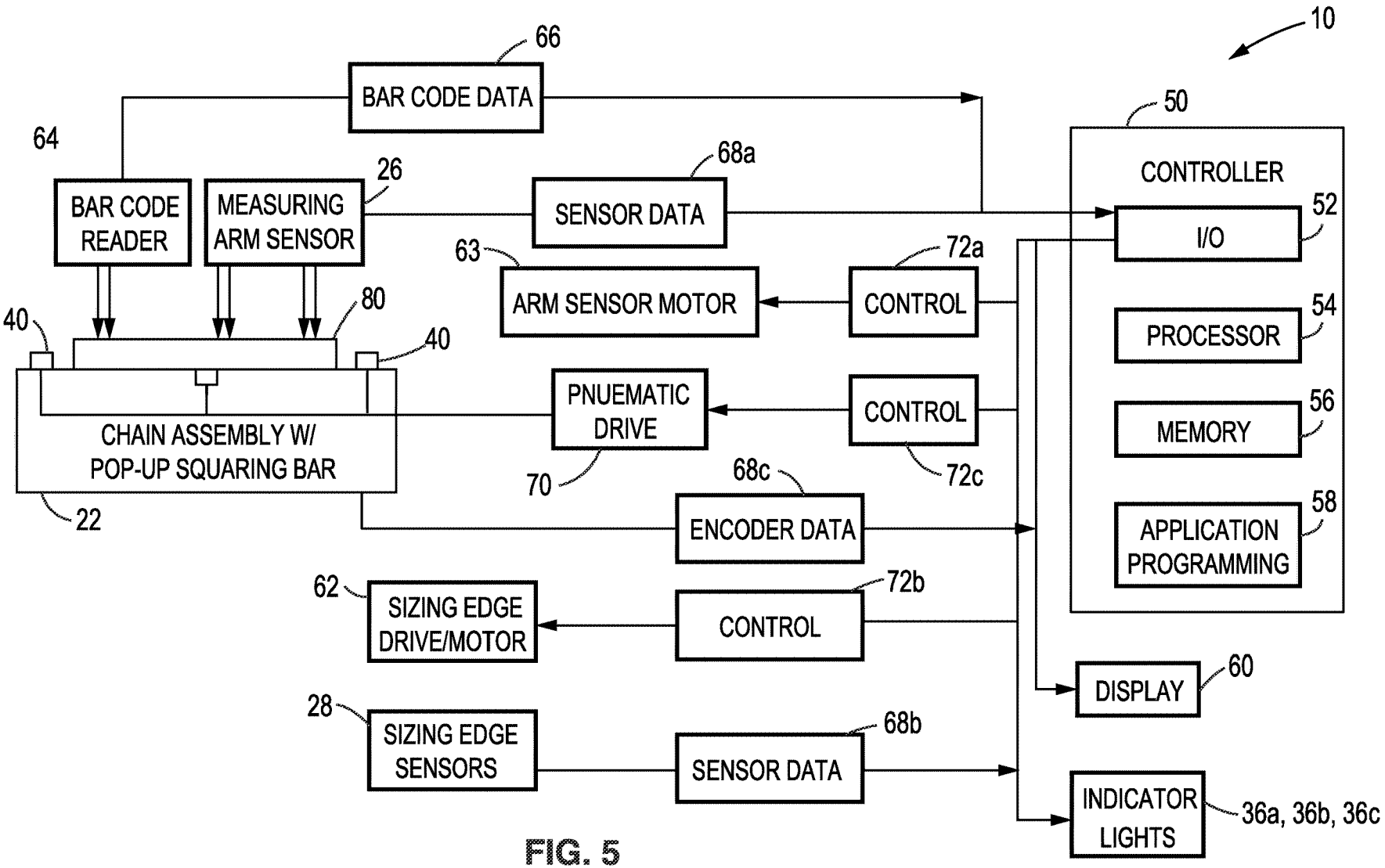
FIG. 5 shows a schematic diagram of the components and controller for the automatic squaring and sizing SET system of the present description.

FIG. 5 shows a schematic diagram of the components and controller 50 for the automatic squaring and sizing SET system 10 of the present description. In one embodiment, controller 50 comprises the Programmable Logic Controller (PLC) built in to the SET 12. It is also appreciated that or more of the functions of controller 50 may be implemented on an external computing device (e.g. computer or server) coupled to the SET 12.

Controller 50 comprises a processor 54 configured for executing application programming 58 comprising code and/or instructions for implementing various functions within the system 10. Application programming 58 may be stored in memory 56, which may reside locally on the SET 12 or at a remote location. The controller 50 comprises input/output lines 52 for communicating with (e.g. reception of sensor data or sending control commands) the various components in the system 10.

In one exemplary configuration, controller 50 is coupled to a display or monitor 60 for displaying information about the system 10 and/or processes. Display 60 may also a comprise a touch screen, or other input device, for receiving input from the operator.

In one embodiment, system 10 may include a bar code reader/scanner 64 for receiving bar code data 66 regarding the doors to be processed. For example, the operator could scan a bar code provided on a door, or pallet of doors, which may contain data with respect to the door that is pertinent to processing (e.g. dimensions of the door or set of doors). It is appreciated that reader/scanner 64 may comprise other scanning devices know in the art, e.g. a QR reader or RFID reader configured to scan a QR code or RFID code provided on the door 80.

In a preferred embodiment, the controller 50 is also configured to receive measuring or sensor data 68*a*/68*b* from the measuring arm sensor 26 and sizing edge sensors 28 for determining board dimensions (e.g. to supplement bar code data 66 or determine board dimensions in the absence of bar code data 66). The controller 50 may also send commands to sensors 26/28.

In one embodiment, encoder data 68*c* from the chain assembly 22 is also acquired for use in determining board dimensions. In one exemplary configuration, sensors 28 comprises a linear array of IR sensors disposed at specified intervals (e.g. 2" spacing) configured to determine if board material is in the line of sight of the sensor. For example, if the first 5 of the sensors in the array register board material and the 6th does not, then it can be determined that the board is between 10" and 12". For further refinement in the board measurement, the chain assembly encoder data 68*c*, which provides data regarding the position of the chain assembly, and therefore the position of the board 80 as it passes between successive sensors, is used to compute the exact dimension of the board 80 in the direction of the sensor array 28.

Controller 50 is also configured to supply control data 72*a*, 72*b* and 72*c* to the drive the sensor arm 20, edge guide assembly 30, and pop-up bar 40, respectively. In one embodiment, the edge guide assembly 30 comprises a motor 62 (e.g. stepper or servo motor or the like), which drives the location of the sizing edge guide 32 on rail 34 via commands 72*b*. Similarly, sensor arm 20 comprises a motor 63 responsive to commands 76*a* to scan in the y-direction along sensor arm 20 until the edge of the board 80 is detected, upon which arm sensor 26 location data 68*a* is sent to the controller 50.

Furthermore, the location (e.g. up or down state) of the pop-up squaring bars 40 may be controlled via commands 72*c* based on a measured or pre-acquired length of the board to be processed. In one embodiment, positioning of the pop-up squaring bars 40 is driven by a pneumatic drive 70, which may comprise a pressurized air source (e.g. $CO_2$ cannister), manifold, and individually driven valves (all not shown) that are coupled to each of the pop-up squaring bars 40 to individually control timing of extension of specific pop-up bars 40. As shown in FIG. 5 the pop-up squaring bar 40 underneath board 80 is shown retracted, while pop-up squaring bars 40 on either side of the board 80 are extended. While one pop-up squaring bar 40 is shown retracted in FIG. 5, it is appreciated that any number of bars may be retracted based on the measured or pre-acquired length of the board 80 to be processed.

In addition to output on display 60, the controller 50 is also coupled to indicator lights 36*a*, 36*b*, and 36*c* for timing of their illumination during certain phases of board 80 processing, which is described in further detail below.

Typically, application programming 58 comprises instructions for receiving all acquired sensor/code data 66, 68*a*, 68*b*, 68*c*, processing the data, and sending commands 72*a*, 72*b* and 72*c* and instructions to the operator via display 60 or indicators 36*a*, 36*b*, and 36*c*.

FIG. 6A through FIG. 6D show the various processing steps in processing a series of boards via the automatic squaring and sizing SET system 10. The illustrations in FIG. 6A through FIG. 6D show four successive processing steps on a series of board (depicted 1-9). It is appreciated that any number of boards and/or board lengths may be processed based on production demands and/or overall system size.

Figure 6A:
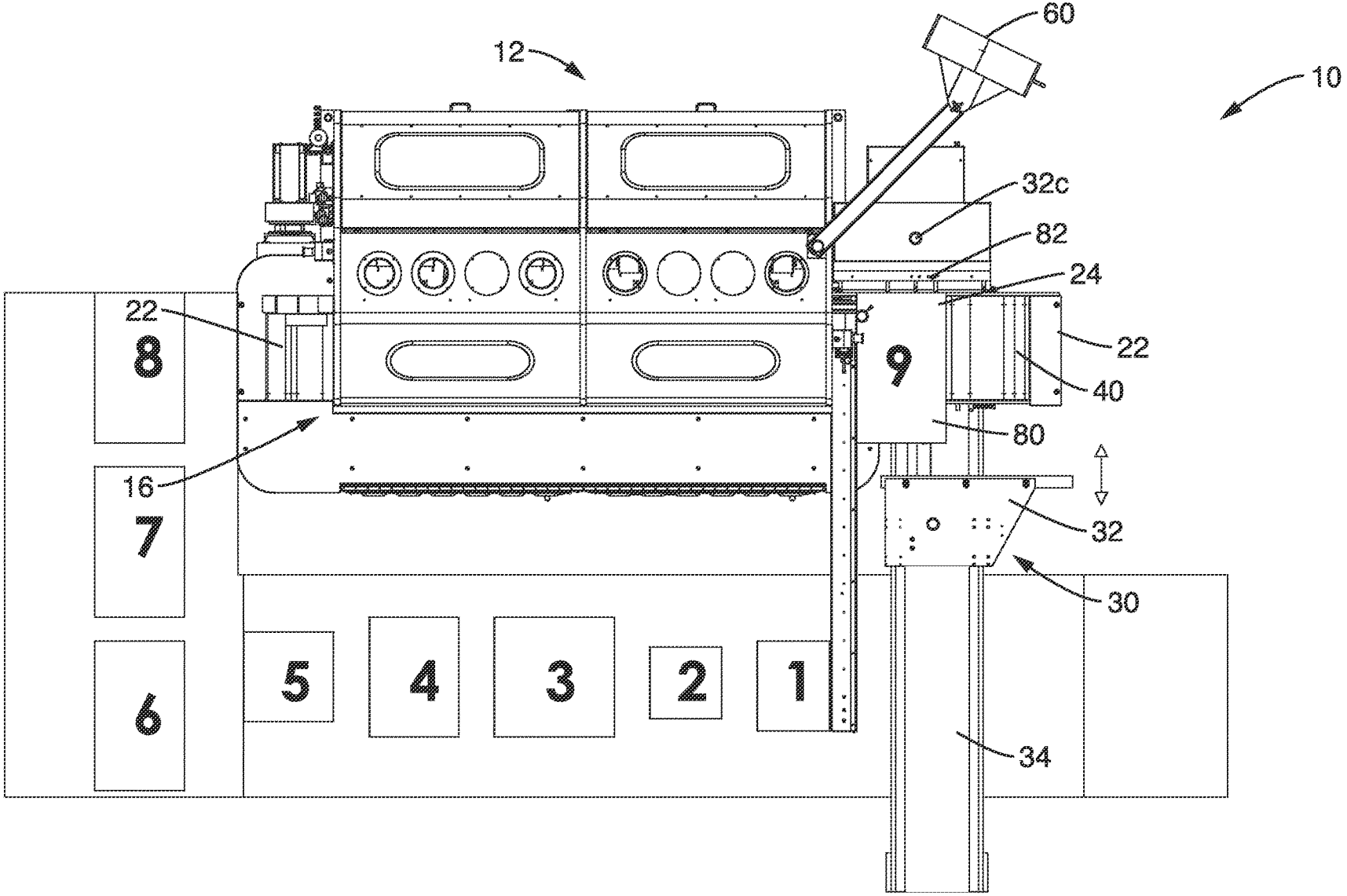
FIG. 6A shows a plan view illustrating a first processing step in a method of processing a door using the SET system of the present description.

FIG. 6A shows a plan view illustrating the first processing step in a method of processing a door (or series of doors) using the SET system 10. The top edge 82 of the doors (the last door in the series (door 9) is shown in FIG. 6A through FIG. 6D for reference) are fed into the SET 12 opening 14 using the stationary edge guide 24, which is positioned in relationship with the milling and sander tools within the SET 12. Indicator 36*c* on the stationary edge guide 24 is illuminated (e.g. green light or the like) and/or instruction is sent to display 60, to indicate which edge to line up top edge 82 to during this process step.

In one embodiment, as each door 80 is fed into the SET 12, a bar code or RFID, or similar identifier on the door 80, is scanned by reader 64, providing the application programming or software 58 data 66 comprising the desired length and width of the door, or any other data with respect to processing of the door 80. This data 66 may be provided in the code, or in a database or other repository that the controller can access (e.g. over a network connection to an external database, or in a local database stored in memory 56).

Alternatively to or in combination with reader data 66, measurement data 68*a*, 68*b* and 68*c* may be used in obtaining the dimensions of each board 80 administered into the SET 12. In one exemplary configuration, a command 72*a* is sent to the arm sensor motor 63 to drive arm sensor 26 along the sensor arm 20 to scan the board 80. When the edge of the board 80 is reached, position data 68*a* is sent back to the controller 50.

As the operator feeds doors into the SET 12, the application programming 58 records these dimensions and sequentially adds up the longest side of each of the doors. When the longest side of the doors fed into the system 10 equals or nears the length of the path of the SET 12 plus the return conveyor 18, the application programming 58 the operator to stop feeding new doors (e.g. via a command for output on the display 50 and/or cessation (or change in color) of illuminator 36*a*, so as to not overload the system 10. The application programming 58 then notifies the operator to start processing the remaining three sides of all the doors 80 that the first (top) edge 82 of which has been processed (in this case the top edge is milled and sanded to the specified profile).

Figure 6B:
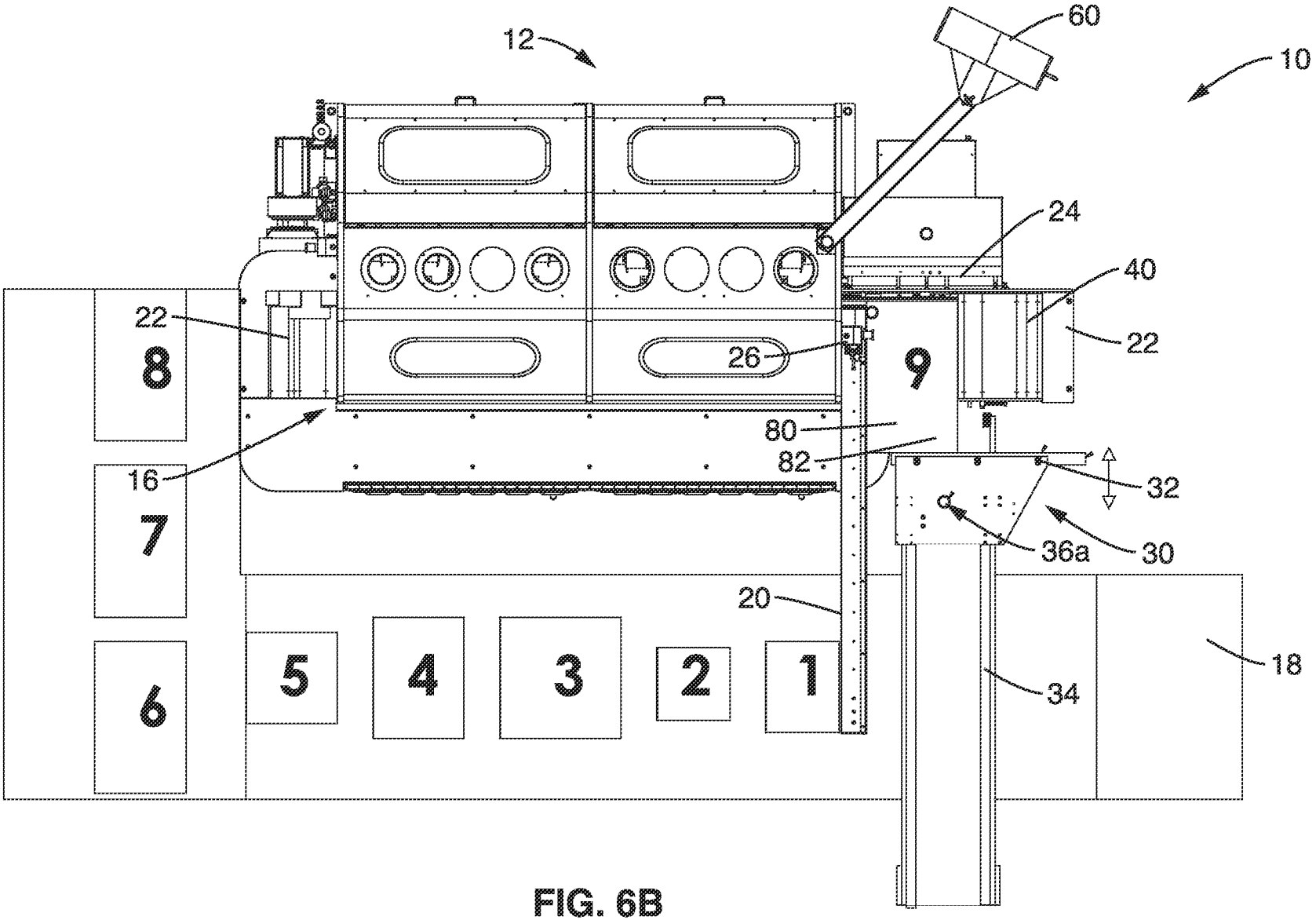
FIG. 6B shows a plan view illustrating a second processing step in a method of processing a door using the SET system of the present description.

FIG. 6B shows a plan view illustrating the second processing step. Now that the top edge 82 of all the doors 80 loaded in the system 10 are machined and sanded and all the desired lengths of the doors are recorded, application programming 58 and controller 50 send a command 72*b* to motor 62 of drive assembly 30 to automatically translate the sizing edge guide 32 along track 34 into the position corresponding to the desired length of the first door 80 (e.g. door 1 in FIG. 6B shown in first position on the conveyor 18). The sizing edge guide indicator 36*a* on the sizing edge guide 32 is illuminated (e.g. green light or the like) to indicate which edge to line up top edge 82 with during this process step. Similar notification (e.g. a graphical illustration) may be provided on display 60). The operator places the top edge 82 of the door 80 against the sizing edge guide 32 and feeds it into opening 14 the SET 12 to mill and sand the bottom edge. After this first door has entered the SET 12, application programming 58 and controller 50 send a command to motor 62 of drive assembly 30 to automatically translate the sizing edge guide 32 along track 34 into to the desired length of the second door on the return conveyor 18 that is ready for processing by the operator. This is repeated until all of the bottom surfaces of the doors in the system 10 are processed.

After all the doors in the system 10 have gone through the second process step, the top and bottom edge of the doors are now parallel to each other and the doors are machined to the desired length dimension. It is understood that the doors are delivered for processing with some degree of oversizing (unprocessed dimensions), allowing for processing of all sizes to be completed to the final desired door dimensions.

Figure 6C:
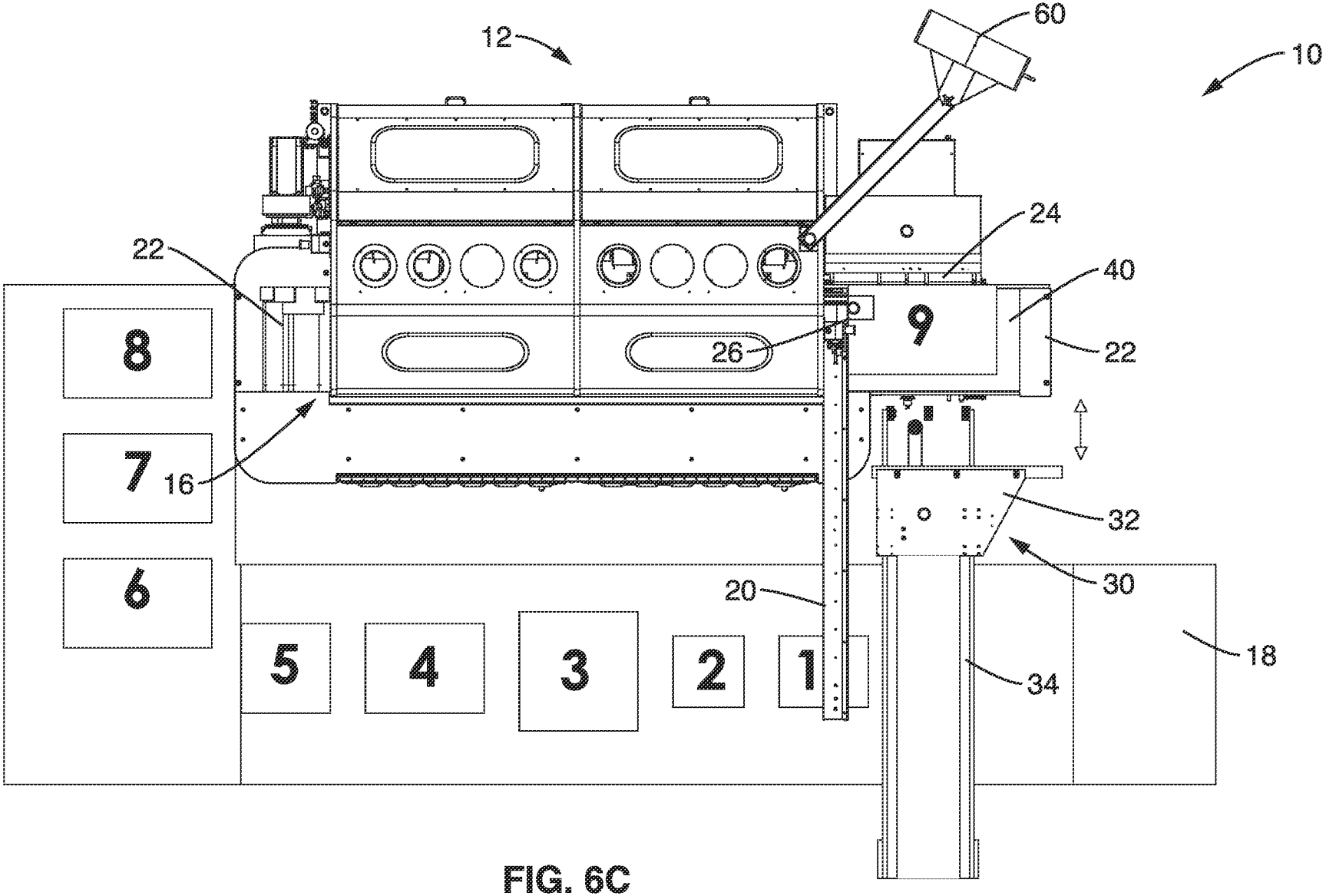
FIG. 6C shows a plan view illustrating a third processing step in a method of processing a door using the SET system of the present description.

FIG. 6C shows a plan view illustrating the third processing step. After the last board is fed into the SET 12 in the second processing step, the application programming 58 and controller 50 send a command 72*a* to pneumatic drive 70 to extend a pair of pop-up squaring bars 40 corresponding to the recorded length of the next board to be positioned on the chain assembly 22. In one embodiment, the pop-up squaring bars 40 are 15" wide in length (for 17" length chain assembly 22), and the squaring bars 40 automatically pop up ½ above the feed chain height. These squaring bars 40 are part of the feed chain and travel with it through the SET 12. The system 10 automatically pops up the squaring bars 40 at the desired spacing to allow all the doors 80 to fit in between the squaring bars. The pop-up bar indicator 36*b* is illuminated (e.g. green light or the like) and/or instruction is sent to display 60 to indicate which edge to line up top or bottom edge with during this process step.

The operator then places the top 82 or bottom edge of the first door 80 on return conveyor 18 against the squaring bar 40 on the chain 22 and against the stationary edge guide 24. This ensures the top or bottom edge is firmly placed against the squaring bar 40 as it travels into the SET 12. One adjacent long side of the door (that is placed against stationary edge guide 24) is the milled and sanded. This process is then repeated for all the remaining doors in the system 10. At the end of this process, one long edge or side of the door is now milled, sanded, and perpendicular to the top and bottom edges.

Figure 6D:
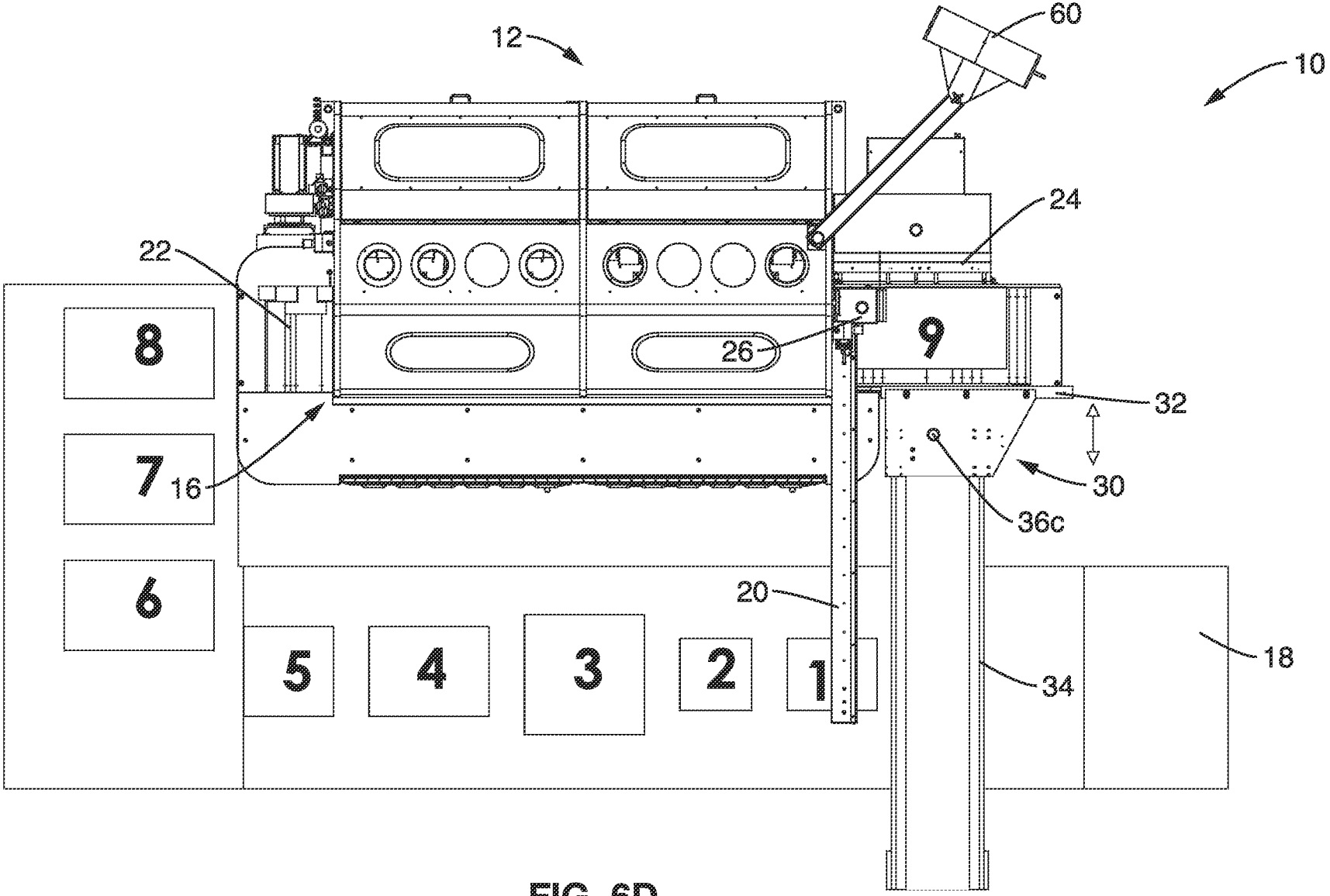
FIG. 6D shows a plan view illustrating a fourth processing step in a method of processing a door using the SET system of the present description.

FIG. 6D shows a plan view illustrating the fourth and final processing step in the method of processing a door using the SET system of the present description. This process is exactly the same as the second processing step (sizing guide indicator 36*c* is illuminated and the sizing edge guide 32 is translated along track 34 corresponding to the desired final length of the board), except the long side of the doors 80 that have already been machine are placed against the sizing guide edge 32 and the last remaining, long-side edge is milled and sanded. After the fourth step, the two long sides are parallel and sized to the desired width of the door 80.

It is appreciated that the sequence or order of which side of the door is processed may be varied (e.g. in a clockwise or counter-clockwise fashion rather than sets of opposing sides). However, the steps as outlined above provide the preferred configuration for processing with minimal or no cumulative processing error.

Appendix A details an exemplary configuration of code and/or processing instructions that may be implemented within application programming 58 for implementing one or more of the processing steps or system controls detailed above.

Embodiments of the present technology may be described herein with reference to flowchart illustrations of methods and systems according to embodiments of the technology, and/or procedures, algorithms, steps, operations, formulae, or other computational depictions, which may also be implemented as computer program products. In this regard, each block or step of a flowchart, and combinations of blocks (and/or steps) in a flowchart, as well as any procedure, algorithm, step, operation, formula, or computational depiction can be implemented by various means, such as hardware, firmware, and/or software including one or more computer program instructions embodied in computer-readable program code. As will be appreciated, any such computer program instructions may be executed by one or more computer processors, including without limitation a general purpose computer or special purpose computer, or other programmable processing apparatus to produce a machine, such that the computer program instructions which execute on the computer processor(s) or other programmable processing apparatus create means for implementing the function(s) specified.

Accordingly, blocks of the flowcharts, and procedures, algorithms, steps, operations, formulae, or computational depictions described herein support combinations of means for performing the specified function(s), combinations of steps for performing the specified function(s), and computer program instructions, such as embodied in computer-readable program code logic means, for performing the specified function(s). It will also be understood that each block of the flowchart illustrations, as well as any procedures, algorithms, steps, operations, formulae, or computational depictions and combinations thereof described herein, can be implemented by special purpose hardware-based computer systems which perform the specified function(s) or step(s), or combinations of special purpose hardware and computer-readable program code.

Furthermore, these computer program instructions, such as embodied in computer-readable program code, may also be stored in one or more computer-readable memory or memory devices that can direct a computer processor or other programmable processing apparatus to function in a particular manner, such that the instructions stored in the computer-readable memory or memory devices produce an article of manufacture including instruction means which implement the function specified in the block(s) of the flowchart(s). The computer program instructions may also be executed by a computer processor or other programmable processing apparatus to cause a series of operational steps to be performed on the computer processor or other programmable processing apparatus to produce a computer-implemented process such that the instructions which execute on the computer processor or other programmable processing apparatus provide steps for implementing the functions specified in the block(s) of the flowchart(s), procedure (s) algorithm(s), step(s), operation(s), formula(e), or computational depiction(s).

It will further be appreciated that the terms "programming" or "program executable" as used herein refer to one or more instructions that can be executed by one or more computer processors to perform one or more functions as described herein. The instructions can be embodied in software, in firmware, or in a combination of software and firmware. The instructions can be stored local to the device in non-transitory media, or can be stored remotely such as on a server, or all or a portion of the instructions can be stored locally and remotely. Instructions stored remotely can be downloaded (pushed) to the device by user initiation, or automatically based on one or more factors.

It will further be appreciated that as used herein, that the terms processor, hardware processor, computer processor, central processing unit (CPU), and computer are used synonymously to denote a device capable of executing the instructions and communicating with input/output interfaces and/or peripheral devices, and that the terms processor, hardware processor, computer processor, CPU, and computer are intended to encompass single or multiple devices, single core and multicore devices, and variations thereof.

From the description herein, it will be appreciated that the present disclosure encompasses multiple embodiments which include, but are not limited to, the following:

1. An automatic sizing and squaring single end tenoner (SET) system for machining edges of a substrate, the system comprising; a SET comprising one or more cutting surfaces, an entrance allowing feeding of a board for processing, and a chain assembly for carrying the board from the entrance, along the one or more cutting surfaces, and out an exit; wherein the SET is configured to sequentially process successive sides of the substrate; a stationary edge guide positioned on one side of the chain assembly and aligned with the one or more cutting surfaces of the SET; a moveable edge guide positioned on an opposite side of the chain assembly from the stationary edge guide; and a controller coupled to the SET and the moveable edge guide; wherein the controller is configured to acquire one or more dimensions of the substrate; and wherein the controller is configured to control movement of the moveable edge guide to a location based on the one or more acquired dimensions such that the SET cutting surfaces automatically cuts two edges of the substrate to create one or more of an angular relationship or specified length between the two cut edges on successive first and second passes of the two cut edges through the SET.

2. The system, apparatus or method of any of the preceding or following embodiments, wherein the controller is configured to control movement of the moveable edge guide to a location based on the one or more acquired dimensions such that the SET cutting surfaces automatically cuts two opposing edges of the substrate to create a parallel relationship and specified length in a first direction between the opposing edges on successive first and second passes of the two opposing edges through the SET.

3. The system, apparatus or method of any of the preceding or following embodiments, wherein the controller is configured to control movement of the moveable edge guide to a location based on the one or more acquired dimensions such that the SET cutting surfaces automatically cuts third and fourth opposing edges adjacent the first and second edges to create a parallel relationship and specified length in a second direction between the opposing third and fourth edges on successive third and fourth passes of the two opposing third and fourth edges through the SET.

4. The system, apparatus or method of any of the preceding or following embodiments, wherein the third and fourth opposing edges are substantially perpendicular to the first and second opposing edges to generate a substantially square substrate at specified dimensions in the first and second directions.

5. The system, apparatus or method of any of the preceding or following embodiments, further comprising: a reader coupled to the controller; the reader configured to scan a surface of the substrate comprising one or more of a bar code, QR code, or RFID tag on the substrate; said bar code, QR code, or RFID tag comprising data associated with the one or more dimensions.

6. The system, apparatus or method of any of the preceding or following embodiments, further comprising: a sensor coupled to the controller; the sensor configured to detect presence of a surface of the substrate to compute a length of the substrate in at least a first of the one or more dimensions.

7. The system, apparatus or method of any of the preceding or following embodiments, wherein the sensor comprises a scanning sensor configured to travel in a first direction corresponding to a first edge of the substrate.

8. The system, apparatus or method of any of the preceding or following embodiments, wherein the scanning sensor is disposed on a sensor arm disposed over the chain assembly in an orientation perpendicular to a direction of travel of the chain assembly.

9. The system, apparatus or method of any of the preceding or following embodiments, further comprising: a linear array of sensors disposed on the moveable edge guide in an orientation perpendicular to the sensor arm; the linear array configured to detect the presence of the substrate surface to compute a length of the substrate in a second dimension.

10. The system, apparatus or method of any of the preceding or following embodiments, further comprising: a return conveyor coupled to the exit of the SET; wherein the SET is configured to receive multiple substrates for processing; wherein the controller is configured to sum a longest edge length of each substrate input for processing in the SET; and indicate to an operator when a total length of the longest edge of all input substrates nears or is equal to a length of the return conveyor and processing region of the SET between the entrance and exit.

11. The system, apparatus or method of any of the preceding or following embodiments: wherein the chain assembly comprises a plurality of pop-up squaring bars disposed within specified chain pads of the chain assembly; wherein the pop-up squaring bars are coupled to the controller such that one or more of the pop-up squaring bars extend above a surface of the chain assembly to provide a squaring edge used to generate square adjacent edges of the substrate.

12. The system, apparatus or method of any of the preceding or following embodiments: wherein the controller is configured to control extension of a pair of pop-up squaring bars according to a length of the substrate to be processed.

13. The system, apparatus or method of any of the preceding or following embodiments, further comprising: a plurality of indictors coupled to the system at locations corresponding to the stationary edge guide, the moveable edge guide, and the squaring edge; wherein the controller is configured to activate one of the plurality of indictors to indicate which of the edge guide, the moveable edge guide, and the squaring edge the substrate is placed during specified processing steps.

14. An apparatus for automatic sizing and squaring of a substrate having edges for machining with a single end tenoner (SET), the SET comprising one or more cutting surfaces, an entrance allowing feeding of a substrate for processing, and a chain assembly for carrying the substrate from the entrance, along the one or more cutting surfaces, and out an exit, wherein the SET is configured to sequentially process successive sides of the substrate, the apparatus comprising: (a) a stationary edge guide positioned on one side of the chain assembly and aligned with the one or more cutting surfaces of the SET; (b) a moveable edge guide positioned on an opposite side of the chain assembly from the stationary edge guide; (c) a processor coupled to the moveable edge guide; and (d) a non-transitory memory storing instructions executable by the processor; (e) wherein said instructions, when executed by the processor, perform steps comprising: (i) acquiring one or more dimensions of the substrate; and (ii) controlling movement of the moveable edge guide to a location based on the one or more acquired dimensions such that the SET cutting surfaces automatically cuts two edges of the substrate to create one or more of an angular relationship or specified length between the two cut edges on successive first and second passes of the two cut edges through the SET.

15. The system, apparatus or method of any of the preceding or following embodiments, wherein said instructions when executed by the processor further perform steps comprising: controlling movement of the moveable edge guide to a location based on the one or more acquired dimensions such that the SET cutting surfaces automatically cuts two opposing edges of the substrate to create a parallel relationship and specified length in a first direction between the opposing edges on successive first and second passes of the two opposing edges through the SET.

16. The system, apparatus or method of any of the preceding or following embodiments, wherein said instructions when executed by the processor further perform steps comprising: controlling movement of the moveable edge guide to a location based on the one or more acquired dimensions such that the SET cutting surfaces automatically cuts third and fourth opposing edges adjacent the first and second edges to create a parallel relationship and specified length in a second direction between the opposing third and fourth edges on successive third and fourth passes of the two opposing third and fourth edges through the SET.

17. The system, apparatus or method of any of the preceding or following embodiments, wherein the third and fourth opposing edges are substantially perpendicular to the first and second opposing edges to generate a substantially square substrate at specified dimensions in the first and second directions.

18. The system, apparatus or method of any of the preceding or following embodiments, further comprising: a reader coupled to the processor; the reader configured to scan a surface of the substrate comprising one or more of a bar code, QR code, or RFID tag on the substrate; said bar code, QR code, or RFID tag comprising data associated with the one or more dimensions.

19. The system, apparatus or method of any of the preceding or following embodiments, further comprising: a sensor coupled to the processor; the sensor configured to detect presence of a surface of the substrate to compute a length of the substrate in at least a first of the one or more dimensions.

20. The system, apparatus or method of any of the preceding or following embodiments, wherein the sensor comprises a scanning sensor configured to travel in a first direction corresponding to a first edge of the substrate.

21. The system, apparatus or method of any of the preceding or following embodiments, wherein the scanning sensor is disposed on a sensor arm disposed over the chain assembly in an orientation perpendicular to a direction of travel of the chain assembly.

22. The system, apparatus or method of any of the preceding or following embodiments, further comprising: a linear array of sensors disposed on the moveable edge guide in an orientation perpendicular to the sensor arm; the linear array configured to detect the presence of the substrate surface to compute a length of the substrate in a second dimension.

23. The system, apparatus or method of any of the preceding or following embodiments, further comprising: a return conveyor coupled to the exit of the SET; wherein the SET is configured to receive multiple substrates for processing; wherein the instructions are configured to: sum a longest edge length of each substrate input for processing in the SET; and indicate to an operator when a total length of the longest edge of all input substrates nears or is equal to a length of the return conveyor and processing region of the SET between the entrance and exit.

24. The system, apparatus or method of any of the preceding or following embodiments: wherein the chain assembly comprises a plurality of pop-up squaring bars disposed within specified chain pads of the chain assembly; wherein the pop-up squaring bars are coupled to the processor such that one or more of the pop-up squaring bars extend above a surface of the chain assembly to provide a squaring edge used to generate square adjacent edges of the substrate.

25. The system, apparatus or method of any of the preceding or following embodiments: wherein the instructions are configured to control extension of a pair of pop-up squaring bars according to a length of the substrate to be processed.

26. The system, apparatus or method of any of the preceding or following embodiments, further comprising: a plurality of indictors coupled to the system at locations corresponding to the stationary edge guide, the moveable edge guide, and the squaring edge; wherein the instructions are further configured to activate one of the plurality of indictors to indicate which of the edge guide, the moveable edge guide, and the squaring edge the substrate is placed during specified processing steps.

27. A method for automatic sizing and squaring of a substrate having edges for machining with a single end tenoner (SET), the SET comprising one or more cutting surfaces, an entrance allowing a substrate for processing is fed, and a chain assembly for carrying the substrate from the entrance, past the one or more cutting surfaces, and out an exit, and a stationary edge guide positioned on one side of the chain assembly and aligned with the one or more cutting surfaces of the SET; wherein the SET is configured to sequentially process successive sides of the substrate, the method comprising: acquiring one or more dimensions of the substrate; and controlling movement of the moveable edge guide to a location based on the one or more acquired dimensions such that the SET cutting surfaces automatically cuts two edges of the substrate to create one or more of an angular relationship or specified length between the two cut edges on successive first and second passes of the two cut edges through the SET.

28. A method for automatic sizing and squaring of a substrate having edges for machining with a single end tenoner (SET) using any of the apparatus or systems detailed above.

As used herein, the singular terms "a," "an," and "the" may include plural referents unless the context clearly dictates otherwise. Reference to an object in the singular is not intended to mean "one and only one" unless explicitly so stated, but rather "one or more."

As used herein, the term "set" refers to a collection of one or more objects. Thus, for example, a set of objects can include a single object or multiple objects.

As used herein, the terms "substantially" and "about" are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. An automatic sizing and squaring single end tenoner (SET) system for machining edges of a substrate, the system comprising;

a SET comprising one or more cutting surfaces, an entrance allowing feeding of a substrate for processing, and a chain assembly for carrying the substrate from the entrance, along the one or more cutting surfaces, and out an exit;

wherein the SET is configured to sequentially process successive sides of the substrate;

a stationary edge guide positioned on one side of the chain assembly and aligned with the one or more cutting surfaces of the SET;

a moveable edge guide positioned on an opposite side of the chain assembly from the stationary edge guide; and a controller coupled to the SET and the moveable edge guide;

wherein the controller is configured to acquire one or more dimensions of the substrate; and wherein the controller is configured to control movement of the moveable edge guide to a location based on the one or more acquired dimensions such that the SET cutting surfaces automatically cuts two edges of the substrate to create one or more of an angular relationship or specified length between the two cut edges on successive first and second passes of the two cut edges through the SET;

wherein the chain assembly comprises a plurality of pop-up squaring bars disposed within specified chain pads of the chain assembly;

wherein the pop-up squaring bars are coupled to the controller such that one or more of the pop-up squaring bars extend above a surface of the chain assembly to provide a squaring edge used to generate square adjacent edges of the substrate;

wherein the controller is configured to control extension of a pair of pop-up squaring bars according to a length of the substrate to be processed; and a plurality of indicators coupled to the system at locations corresponding to the stationary edge guide, the moveable edge guide, and the squaring edge;

wherein the controller is configured to activate one of the plurality of indicators to indicate which of the edge guide, the moveable edge guide, and the squaring edge the substrate is placed during specified processing steps.

2. The system of claim 1, wherein the controller is configured to control movement of the moveable edge guide to a location based on the one or more acquired dimensions such that the SET cutting surfaces automatically cuts two opposing edges of the substrate to create a parallel relationship and specified length in a first direction between the opposing edges on successive first and second passes of the two opposing edges through the SET.

3. The system of claim 2, wherein the controller is configured to control movement of the moveable edge guide to a location based on the one or more acquired dimensions such that the SET cutting surfaces automatically cuts third and fourth opposing edges adjacent the first and second edges to create a parallel relationship and specified length in a second direction between the opposing third and fourth edges on successive third and fourth passes of the two opposing third and fourth edges through the SET.

4. The system of claim 3, wherein the third and fourth opposing edges are substantially perpendicular to the first and second opposing edges to generate a substantially square substrate at specified dimensions in the first and second directions.

5. The system of claim 1, further comprising:

a reader coupled to the controller;

the reader configured to scan a surface of the substrate comprising one or more of a bar code, QR code, or RFID tag on the substrate;

said bar code, QR code, or RFID tag comprising data associated with the one or more dimensions.

6. The system of claim 1, further comprising:

a sensor coupled to the controller;

the sensor configured to detect presence of a surface of the substrate to compute a length of the substrate in at least a first of the one or more dimensions.

7. The system of claim 6, wherein the sensor comprises a scanning sensor configured to travel in a first direction corresponding to a first edge of the substrate.

8. The system of claim 7, wherein the scanning sensor is disposed on a sensor arm disposed over the chain assembly in an orientation perpendicular to a direction of travel of the chain assembly.

9. The system of claim 8, further comprising:

a linear array of sensors disposed on the moveable edge guide in an orientation perpendicular to the sensor arm;

the linear array configured to detect the presence of the substrate surface to compute a length of the substrate in a second dimension.

10. The system of claim 1, further comprising:

a return conveyor coupled to the exit of the SET;

wherein the SET is configured to receive multiple substrates for processing; and wherein the controller is configured to sum a longest edge length of each substrate input for processing in the SET and indicate to an operator when a total length of the longest edge of all input substrates nears or is equal to a length of the return conveyor and processing region of the SET between the entrance and exit.

11. An apparatus for automatic sizing and squaring of a substrate having edges for machining with a single end tenoner (SET), the SET comprising one or more cutting surfaces, an entrance allowing feeding of a substrate for processing, and a chain assembly for carrying the substrate from the entrance, along the one or more cutting surfaces, and out an exit, wherein the SET is configured to sequentially process successive sides of the substrate, the apparatus comprising:

(a) a stationary edge guide positioned on one side of the chain assembly and aligned with the one or more cutting surfaces of the SET;

(b) a moveable edge guide positioned on an opposite side of the chain assembly from the stationary edge guide;

(c) a processor coupled to the moveable edge guide; and (d) a non-transitory memory storing instructions executable by the processor;

(e) wherein said instructions, when executed by the processor, perform steps comprising:

(i) acquiring one or more dimensions of the substrate; and (ii) controlling movement of the moveable edge guide to a location based on the one or more acquired dimensions such that the SET cutting surfaces automatically cuts two edges of the substrate to create one or more of an angular relationship or specified length between the two cut edges on successive first and second passes of the two cut edges through the SET;

(f) wherein the chain assembly comprises a plurality of pop-up squaring bars disposed within specified chain pads of the chain assembly;

(g) wherein the pop-up squaring bars are coupled to the processor such that one or more of the pop-up squaring bars extend above a surface of the chain assembly to provide a squaring edge used to generate square adjacent edges of the substrate; and (h) a plurality of indicators coupled to the system at locations corresponding to the stationary edge guide, the moveable edge guide, and the squaring edge;

(i) wherein the instructions are further configured to activate one of the plurality of indicators to indicate which of the edge guide, the moveable edge guide, and the squaring edge the substrate is placed during specified processing steps.

12. The apparatus of claim 11, wherein said instructions when executed by the processor further perform steps comprising:

controlling movement of the moveable edge guide to a location based on the one or more acquired dimensions such that the SET cutting surfaces automatically cuts two opposing edges of the substrate to create a parallel relationship and specified length in a first direction between the opposing edges on successive first and second passes of the two opposing edges through the SET.

13. The apparatus of claim 12, wherein said instructions when executed by the processor further perform steps comprising:

controlling movement of the moveable edge guide to a location based on the one or more acquired dimensions such that the SET cutting surfaces automatically cuts third and fourth opposing edges adjacent the first and second edges to create a parallel relationship and specified length in a second direction between the opposing third and fourth edges on successive third and fourth passes of the two opposing third and fourth edges through the SET.

14. The apparatus of claim 13, wherein the third and fourth opposing edges are substantially perpendicular to the first and second opposing edges to generate a substantially square substrate at specified dimensions in the first and second directions.

15. The apparatus of claim 11, further comprising:

a reader coupled to the processor;

the reader configured to scan a surface of the substrate comprising one or more of a bar code, QR code, or RFID tag on the substrate;

said bar code, QR code, or RFID tag comprising data associated with the one or more dimensions.

16. The apparatus of claim 11, further comprising:

a sensor coupled to the processor;

the sensor configured to detect presence of a surface of the substrate to compute a length of the substrate in at least a first of the one or more dimensions.

17. The apparatus of claim 16, wherein the sensor comprises a scanning sensor configured to travel in a first direction corresponding to a first edge of the substrate.

18. The apparatus of claim 17, wherein the scanning sensor is disposed on a sensor arm disposed over the chain assembly in an orientation perpendicular to a direction of travel of the chain assembly.

19. The apparatus of claim 18, further comprising:

a linear array of sensors disposed on the moveable edge guide in an orientation perpendicular to the sensor arm;

the linear array configured to detect the presence of the substrate surface to compute a length of the substrate in a second dimension.

20. The apparatus of claim 11, further comprising:

a return conveyor coupled to the exit of the SET;

wherein the SET is configured to receive multiple substrates for processing;

wherein the instructions are configured to:

sum a longest edge length of each substrate input for processing in the SET; and indicate to an operator when a total length of the longest edge of all input substrates nears or is equal to a length of the return conveyor and processing region of the SET between the entrance and exit.

21. The apparatus of claim 11:

wherein the instructions are configured to control extension of a pair of pop-up squaring bars according to a length of the substrate to be processed.

* * * * *